US009386823B2

(12) United States Patent
Hadjis

(10) Patent No.: US 9,386,823 B2
(45) Date of Patent: Jul. 12, 2016

(54) MOLDABLE AND REUSABLE MATERIAL POSITIONABLE IN FOOTWEAR AND A TOOL FOR INSERTING, SHAPING, AND REMOVING THE SAME

(71) Applicant: Theodore B. Hadjis, Chicago, IL (US)

(72) Inventor: Theodore B. Hadjis, Chicago, IL (US)

( * ) Notice: Subject to any disclaimer, the term of this patent is extended or adjusted under 35 U.S.C. 154(b) by 628 days.

(21) Appl. No.: 13/799,172

(22) Filed: Mar. 13, 2013

(65) Prior Publication Data

US 2014/0259460 A1 Sep. 18, 2014

(51) Int. Cl.

| | |
|---|---|
| ***A43D 3/14*** | (2006.01) |
| ***A43B 7/14*** | (2006.01) |
| ***A43D 5/00*** | (2006.01) |

(52) U.S. Cl.

CPC ..... *A43D 3/14* (2013.01); *A43B 7/1465* (2013.01); *A43D 5/00* (2013.01)

(58) Field of Classification Search

CPC ..... A43D 3/14; A43D 3/1416; A43D 3/1433–3/1483; A43D 5/00; A43D 5/08; A43B 7/1465

USPC ..... 36/94–97; 12/103, 104.5, 114.2–119.5

See application file for complete search history.

(56) References Cited

U.S. PATENT DOCUMENTS

| | | | | |
|---|---|---|---|---|
| 1,275,069 | A * | 8/1918 | Mikkelsen | A43D 5/00 12/103 |
| 1,682,132 | A * | 8/1928 | Kosek | A61F 2/588 623/65 |
| 1,825,111 | A * | 9/1931 | De Witt | A43D 3/1441 12/103 |
| 2,449,535 | A * | 9/1948 | Scholl | A43B 7/22 12/103 |
| 2,537,368 | A * | 1/1951 | Northrop | A61F 2/588 623/57 |
| 3,380,092 | A * | 4/1968 | Golczyuski | A43B 13/38 12/103 |
| D280,463 | S * | 9/1985 | Sheahan | 294/3.6 |
| 6,079,758 | A * | 6/2000 | Romero | A47G 21/08 224/218 |
| 7,827,707 | B2 * | 11/2010 | Davis | A43B 3/26 36/71 |
| 2010/0042229 | A1 * | 2/2010 | Hawk | A61F 2/586 623/65 |

FOREIGN PATENT DOCUMENTS

| | | | | |
|---|---|---|---|---|
| DE | 2259206 A1 * | 6/1974 | | A43B 3/26 |

OTHER PUBLICATIONS www.futureofdance.com, Pointe Putty, 2 pages, published at least as early as Jan. 10, 2013.

www.puttyworld.com, Stress Reliever—Thinking Putty, 2 pages, published at least as early as Jan. 10, 2013.

www.officeplayground.com/Putty-Goo-C105.aspx, Children's Toy Putty and Goo, 4 pages, published at least as early as Jan. 10, 2013.

www.containerstore.com, Museum Putty, 2 pages, published at least as early as Jan. 10, 2013.

* cited by examiner

*Primary Examiner* — Ted Kavanaugh

(74) *Attorney, Agent, or Firm* — Klintworth & Rozenblat IP LLC

(57) ABSTRACT

Kits, systems, methods, materials, and tools for improving footwear wearability are provided. In one aspect, a kit includes a deformable material adapted to be positioned into footwear, and a tool including a first end and a second end. The first end of the tool is adapted to engage the deformable material, move the material to a desired position in the footwear, and shape the material. The second end of the tool is adapted to engage the material and remove the material from the footwear. In another aspect, a method of improving wearabilty of footwear includes positioning a deformable material into footwear, engaging the material with a first end of a tool, moving the material to a desired portion of the footwear with the tool, and deforming the material into a desired shape with the first end of the tool.

10 Claims, 4 Drawing Sheets

MOLDABLE AND REUSABLE MATERIAL POSITIONABLE IN FOOTWEAR AND A TOOL FOR INSERTING, SHAPING, AND REMOVING THE SAME

FIELD OF THE INVENTION

The present disclosure generally relates to footwear accessories and, more particularly, to footwear accessories positionable in footwear to improve wearability.

BACKGROUND

Finding footwear that fits ideally is oftentimes a difficult task. Additionally, overtime, footwear stretches, deforms, or wears out, thereby providing a poor fit with the user's foot. Footwear can be too large, too small, too wide, too narrow, etc. Unfortunately, such drawbacks are not discovered until the footwear has been worn for a period of time, after which the footwear cannot be returned. Thus, purchasers of the footwear are stuck wearing poorly fitting footwear or they cast aside, discard, or otherwise stop wearing the footwear, thereby resulting in sore feet and/or a waste of money.

SUMMARY

The present disclosure is defined by the following claims, and nothing in this section should be taken as a limitation on those claims.

A need exists for a manner of altering inadequately fitting footwear to be more comfortable and adequately fit a wearer's foot.

In one aspect, a kit is provided and includes a deformable material adapted to be positioned into footwear, and a tool including a first end and a second end. The first end of the tool is adapted to engage the deformable material, move the material to a desired position in the footwear, and shape the material. The second end of the tool is adapted to engage the material and remove the material from the footwear.

In another aspect, a method of improving wearabilty of footwear is provided and includes positioning a deformable material into footwear, engaging the material with a first end of a tool, moving the material to a desired portion of the footwear with the tool, and deforming the material into a desired shape with the first end of the tool.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DETAILED DESCRIPTION

Figure 1:
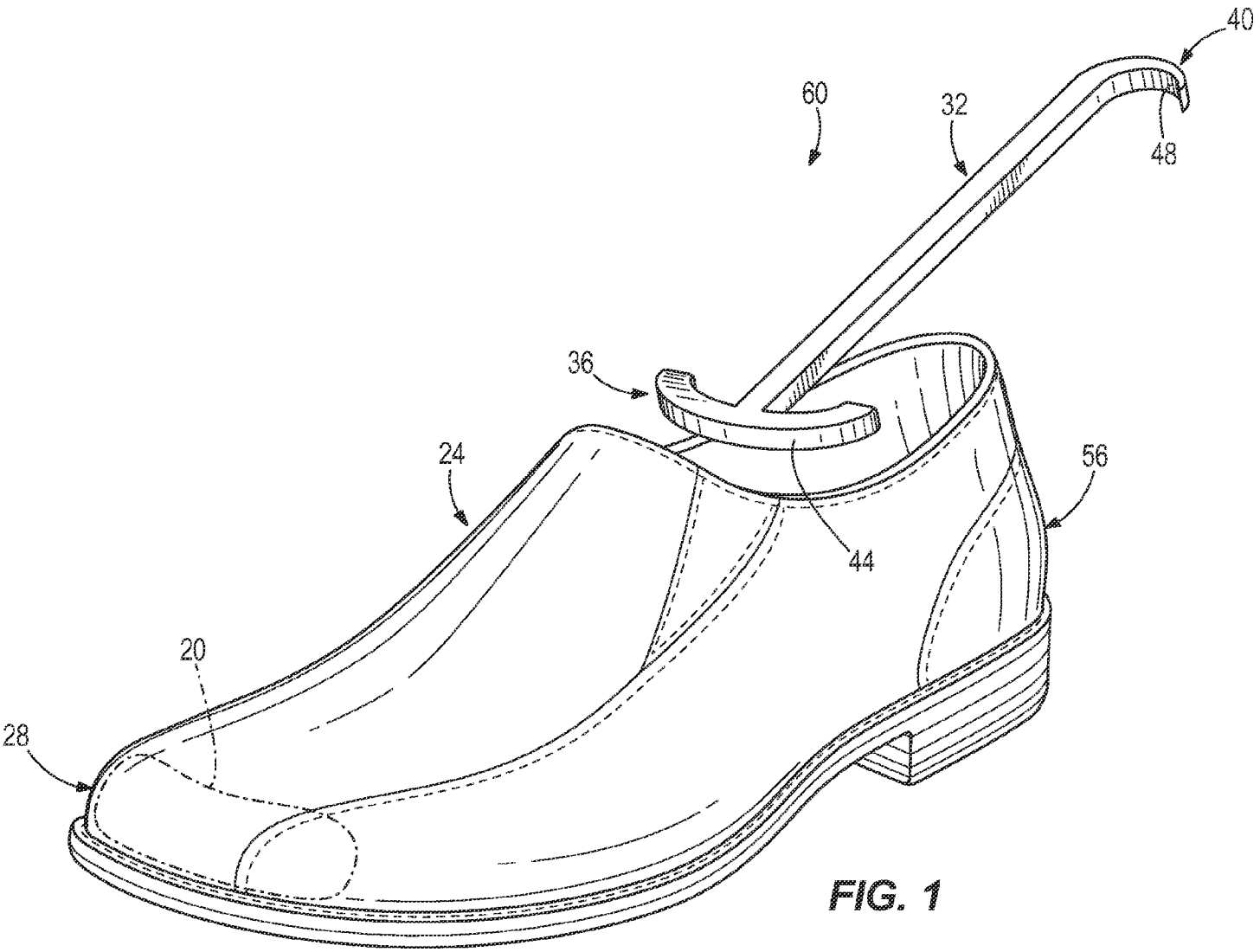
FIG. 1 is a top front perspective view of exemplary footwear, exemplary material positionable in the footwear, and an exemplary tool for inserting, shaping, and removing the material.

With reference to FIG. 1, an exemplary substance or material 20 is illustrated and is adapted to be positioned in footwear 24 to improve wearability of the footwear 24. The material 20 is adapted to be positioned in any type of footwear 24 such as, for example, military shoes or boots, stilettos, other high-heel shoes, men's dress shoes, athletic shoes, or any other men's or women's shoe, or any other type of footwear. The illustrated footwear 24 is merely an exemplary type of footwear and is not intended to be limiting. Rather, as expressed above, the material 20 may be positioned in any type of footwear and all of such possibilities are intended to be within the spirit and scope of the present disclosure.

Footwear oftentimes does not provide desirable wearability to an individual wearing the footwear. For example, the footwear may be inappropriately sized (e.g., too large) to a wearer's foot, thereby causing discomfort to the individual. Also, for example, footwear may have locations causing undesirable discomfort or friction to a user's foot. Moreover, for example, footwear begins to wear or become misshaped overtime and the material 20 is adapted to maintain shape and integrity of the footwear. The material 20 is positionable within footwear to alleviate these undesirable attributes, thereby ultimately improving wearability of the footwear.

The material 20 includes a variety of characteristics that make it beneficial for improving wearability of the footwear 24. For example, the material 20 may be malleable, pliable, moldable or otherwise deformable to allow the material 20 to take a desired shape and to provide a relatively soft surface for a user's foot to engage. At the same time, the material 20 is also, for example, sufficiently durable to provide necessary support to the user's foot when in the footwear 24, inhibit premature deterioration of the material 20, and facilitate reuse of the material 20. Moreover, for example, the material 20 may have tackiness or a sufficient level of friction to inhibit the material 20 from slipping within the footwear 24 and/or to inhibit a user's foot from slipping against the material 20. The material 20 is adapted to remain intact, maintain its molded shape, and remain in position within the footwear 24 when exposed to normal conditions such as, for example, natural foot moisture and normal range of body temperatures. Furthermore, the material 20 may be non-toxic, non-staining, scented or unscented, and may come in a variety of different colors. The various colors may be purely aesthetic and cater to users' color preferences, or the colors may correspond to characteristics of the material 20 such as, for example, durability, tackiness, scent or unscented, size, type of footwear with which to use the material (e.g., men's shoe, women's shoe, athletic shoe, etc.) or any other characteristic of the material 20 to provide a user with visual indication of the characteristics of the material 20.

Figure 2:
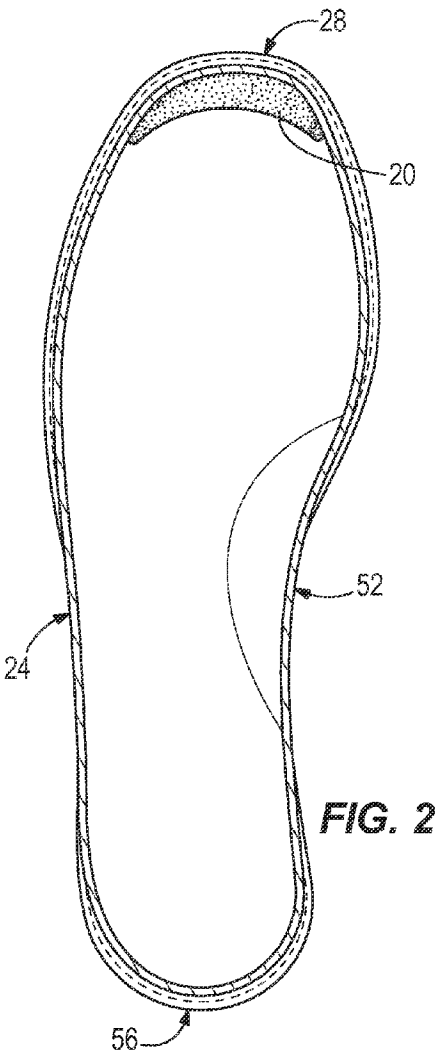
FIG. 2 is a top view of the footwear and material shown in FIG. 1 with a top portion of the footwear removed to expose the interior of the footwear, the material is shown in a toe portion of the footwear.

With reference to FIGS. 1 and 2, the material 20 is positioned in a toe portion 28 of the footwear 24. If an individual has a shoe that is too large for their foot, the individual may position the material 20 in the toe portion 28 to occupy some of the excess space between the toe of the shoe and the individual's foot. The individual's toes engage the material 20 to provide a better fit and inhibit substantial sliding of the individual's foot within the shoe.

Figure 4:
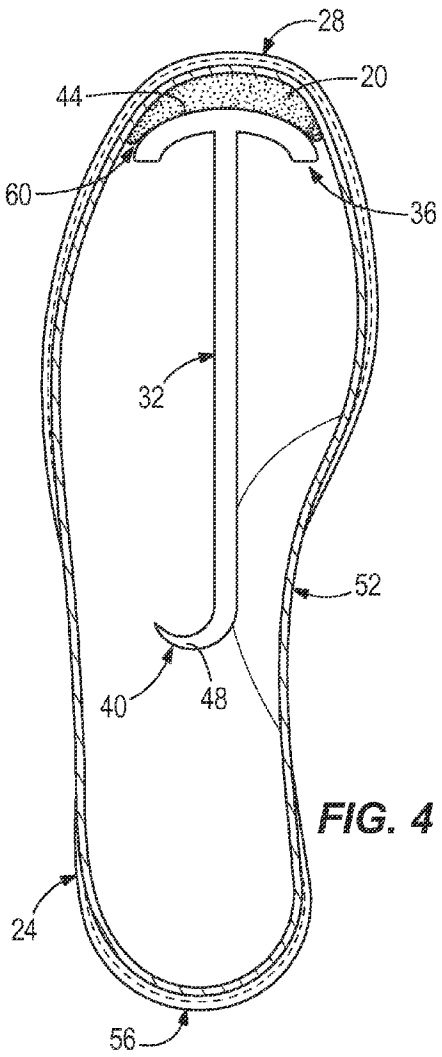
FIG. 4 is a top view similar to FIG. 2 with the material moved into the toe portion of the footwear and shaped with the tool.
Figure 3:
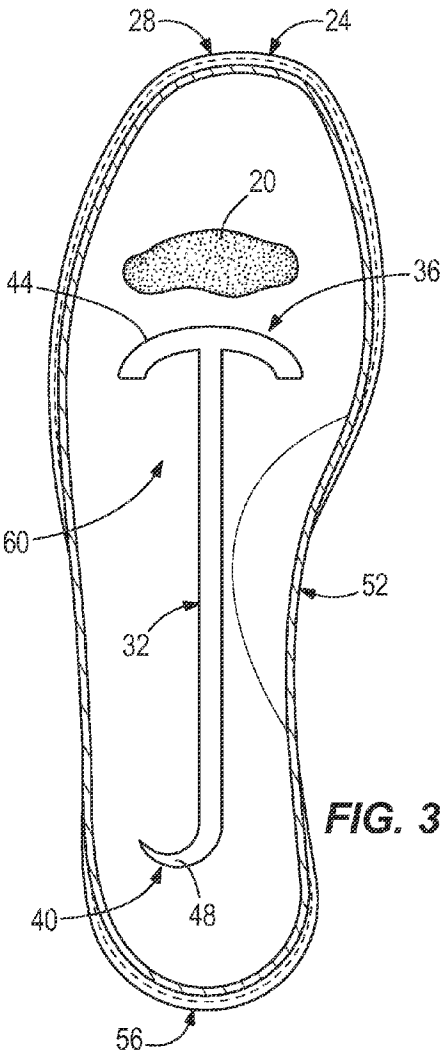
FIG. 3 is a top view similar to FIG. 2 with the material positioned in the shoe and in the process of being moved into the toe portion of the footwear with the tool.

Referring now to FIGS. 1, 3, and 4, the material 20 may be inserted into the footwear 24, moved into a desired position within the footwear 24, desirably shaped, and removed from the footwear 24 using an exemplary tool 32. The tool 32 may have a variety of different configurations, shapes, sizes, etc. and be within the intended spirit and scope of the present disclosure. Additionally, the tool 32 may be comprised of a variety of different materials such as, for example, plastic, metal, or any other material, all of which are intended to be within the spirit and scope of the present disclosure. Furthermore, the tool 32 may be a one-piece unitarily formed tool or may be comprised of multiple components coupled together in any manner such as, for example, fasteners, welding, bonding, adhering, snap-fit, interference-fit, or any other manner of coupling components together.

In the illustrated exemplary embodiment, the tool 32 includes a first end 36 adapted to insert, position, and shape the material 20 and a second end 40 adapted to remove the material 20 from footwear 24. The first end 36 includes an engagement surface 44 adapted to engage the material 20 to move and shape the material 20. In the illustrated exemplary embodiment, the engagement surface 44 is arcuate and may have a variety of different arcuate sizes and shapes in order to provide a variety of different shapes to the material 20. In other exemplary embodiments, the engagement surface 44 may have other shapes such as, for example, flat, polygonal, or any other shape, and all of such shapes are intended to be within the spirit and scope of the present disclosure. The engagement surface 44 of the tool 32 engages and is pushed against the material 20 to move the material 20 into the desired portion of the footwear 24 (e.g., the toe portion 28 as illustrated in FIGS. 1-4). Then, the material 20 is shaped by further pressing the engagement surface 44 of the tool 32 against the material 20 when the material 20 is in the desired portion of the shoe (as shown in FIG. 4). Once the material 20 is desirably shaped, the tool 32 is removed from the footwear 24 and an individual may wear the footwear 24.

Figure 6:
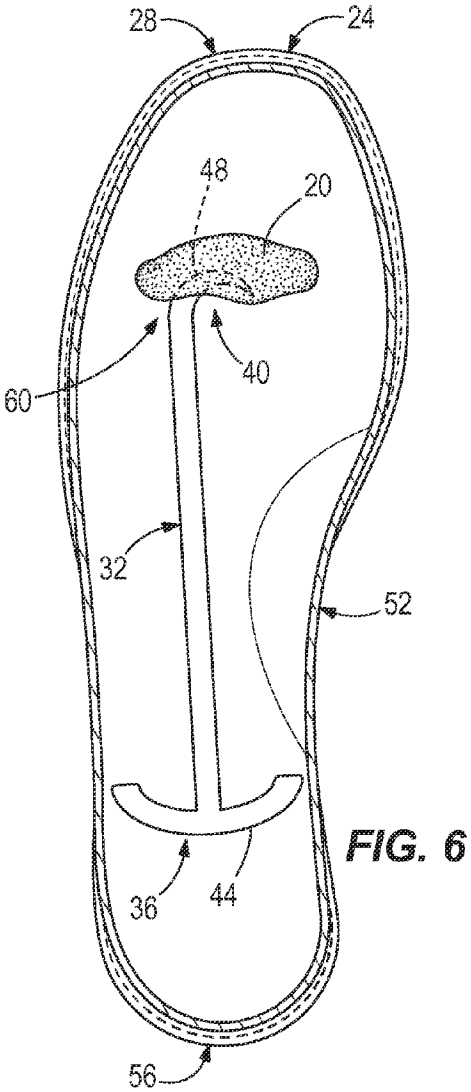
FIG. 6 is a top view similar to FIG. 2 with the material engaged by the tool and in the process of being removed from the footwear.
Figure 5:
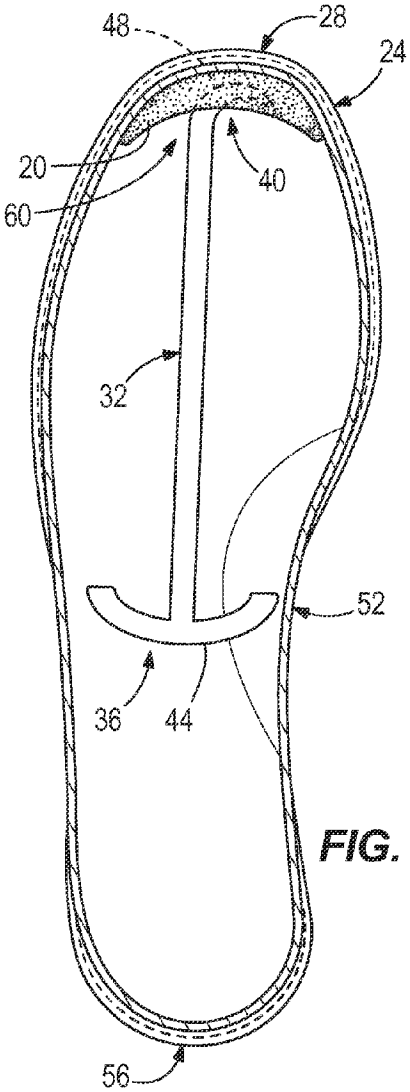
FIG. 5 is a top view similar to FIG. 2 with the material in the toe portion of the footwear, and the tool positioned in the footwear and engaging the material for removal of the material from the footwear.

With reference to FIGS. 5 and 6, the second end 40 of the tool 32 is adapted to remove the material 20 from the footwear 24. The second end 40 includes a removal member 48 adapted to engage (see FIG. 5) and pull (see FIG. 6) the material 20 from the footwear 24. In the illustrated exemplary embodiment, the removal member is a hook 48. In other exemplary embodiments, the removal member 48 may be any shape and size as long as it can engage and remove the material 20 from the footwear 24. The hook 48 is adequately shaped to facilitate penetration of the hook 48 into the material 20 and ensure gripping of the material 20 when the tool 32 is being pulled/removed from the footwear 24.

Figure 7:
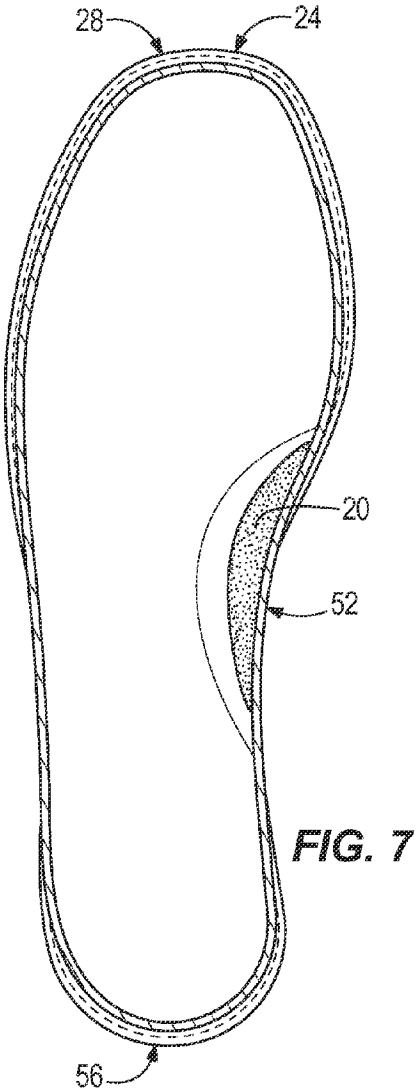
FIG. 7 a top view similar to FIG. 2 with the material shown in an arch portion of the footwear.
Figure 8:
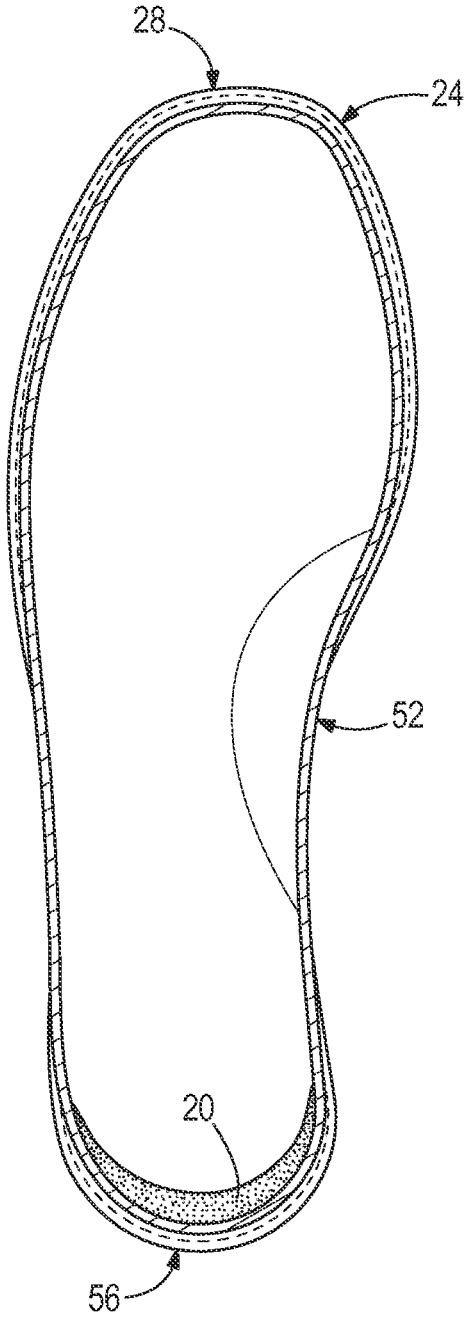
FIG. 8 is a top view similar to FIG. 2 with the material shown in a heel portion of the footwear.

It should be understood that the material 20 may be positioned and desirably shaped anywhere within footwear 24 to improve wearability of the footwear 24. FIGS. 1-6 illustrate the material 20 positioned and shaped in the toe portion 28 of the shoe. Alternatively, for example, the material 20 may be positioned and shaped in an arch portion 52 (see FIG. 7), a heel portion 56 (see FIG. 8), or any other location within the footwear 24. The tool 32 is adapted to insert, position, and shape the material 20 at any location within the footwear 24. Additionally, the tool 32 is adapted to remove the material 20 from any location within the footwear 24.

The material 20 and the tool 32 in combination provide a kit or system 60 adapted to improve the wearability of footwear 24. The kit or system 60 may be used in variety of different manners, methods, or processes. One exemplary process includes inserting the material 20 into footwear 24, engaging the material 20 with the first end 36 (e.g., the engagement surface 44) of the tool 32, moving the material 20 into a desired portion of the footwear 24 with the tool 32, pressing the first end 36 against the material 20 with the material 20 in the desired portion of the footwear 24 to desirably shape the material 20, disengaging the first end 36 of the tool 32 from the material 20 once the material 20 has the desired shape, and removing the tool 32 from the footwear 24. The process may further include removal of the material 20 from the footwear 24 by, for example, inserting the tool 32 into the footwear 24, engaging the material 20 with the second end 40 (e.g., the removal member 48) of the tool 32, penetrating the second end 40 of the tool 32 into the material 20, withdrawing the tool 32 from the footwear 24 while maintaining engagement between the tool 32 and the material 20 to remove the material 20 from the desired portion of the footwear 24, and removing the tool 32 and the material 20 from the footwear 24.

It should be understood that this exemplary process is only one of many possible manners, methods, and processes of using the kit or system, and this and any of the other possible manners, methods, and processes may include fewer, more, or other steps and be within the intended spirit and scope of the present disclosure.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

While various embodiments of the invention have been described, it will be apparent to those of ordinary skill in the art that other embodiments and implementations are possible within the scope of the invention. Accordingly, the invention is not to be restricted except in light of the attached claims and their equivalents.

The invention claimed is:

1. A method of improving wearabilty of footwear, the method comprising:

positioning a deformable material into footwear;

engaging the material with a first end of a tool;

moving the material to a desired portion of the footwear with the tool; and deforming the material from an original shape into a desired shape different than the original shape with the first end of the tool.

2. The method of claim 1, wherein engaging the material with a first end of the tool further comprises engaging the material with an engagement surface of the first end of the tool.

3. The method of claim 2, wherein the engagement surface is arcuate.

4. The method of claim 2, wherein moving the material further comprises moving the material to a desired portion of the footwear with the engagement surface, and wherein deforming the material further comprises deforming the material into a desired shape with the engagement surface.

5. The method of claim 4, wherein the tool is a one-piece unitarily formed tool.

6. The method of claim 1, further comprising:

engaging the material with a second end of the tool; and removing the material from the footwear with the second end of the tool.

7. The method of claim 6, wherein engaging the material with a second end of the tool further comprises engaging the material with a removal member of the second end of the tool, and wherein removing the material further comprises removing the material from the footwear with the removal member.

8. The method of claim 7, wherein the removal member is a hook.

9. The method of claim 7, wherein the tool is a one-piece unitarily formed tool.

10. The method of claim 6, further comprising:

repositioning the material into footwear after removing the material from the footwear;

moving the material to a desired portion of the footwear with the tool after repositioning the material; and deforming the material into a desired shape with the first end of the tool after repositioning the material.

* * * * *